US007530205B2

(12) United States Patent
Simmons

(10) Patent No.: US 7,530,205 B2
(45) Date of Patent: May 12, 2009

(54) STRUCTURAL CHASE BEAM

(76) Inventor: Robert J. Simmons, 27308 Fairview Ave., Hayward, CA (US) 94542

( * ) Notice: Subject to any disclaimer, the term of this patent is extended or adjusted under 35 U.S.C. 154(b) by 738 days.

(21) Appl. No.: 10/700,258

(22) Filed: Nov. 3, 2003

(65) Prior Publication Data

US 2004/0237456 A1 Dec. 2, 2004

Related U.S. Application Data

(60) Provisional application No. 60/424,079, filed on Nov. 5, 2002.

(51) Int. Cl.
*E04H 12/00* (2006.01)

(52) U.S. Cl. ..... 52/650.1; 52/837; 52/838

(58) Field of Classification Search ..... 52/650.1, 52/729.1, 730.4, 730.6, 731.2, 731.7, 732.1, 52/733.3, 737.1, 737.6, 302.3, 220.7
See application file for complete search history.

(56) References Cited

U.S. PATENT DOCUMENTS 542,283 A * 7/1895 Rousseau ..... 52/729.2
1,360,720 A * 11/1920 Brown et al. ..... 52/731.7
2,082,792 A * 6/1937 Dean ..... 52/737.6
2,098,676 A * 11/1937 Rafter ..... 52/636
2,103,064 A * 12/1937 Clark ..... 52/696
2,125,690 A * 8/1938 Ragsdale et al. ..... 52/731.2
2,125,691 A * 8/1938 Ragsdale et al. ..... 52/731.2
2,125,692 A * 8/1938 Ragsdale et al. ..... 52/731.2
2,751,652 A * 6/1956 Epstein ..... 248/57
4,109,440 A * 8/1978 Bill ..... 52/731.2
5,595,040 A * 1/1997 Chen ..... 52/729.1
5,671,573 A * 9/1997 Tadros et al. ..... 52/223.8
5,848,512 A * 12/1998 Conn ..... 52/729.1
6,662,520 B1 * 12/2003 Nelson ..... 52/732.2
2002/0157337 A1 * 10/2002 Hovenier ..... 52/317

* cited by examiner

*Primary Examiner*—Richard E Chilcot, Jr.
*Assistant Examiner*—Jessica Laux
(74) *Attorney, Agent, or Firm*—Jon M. Dickinson, PC; Robert D. Varitz, PC

(57) ABSTRACT

An elongate structural chase beam adapted for assembly in a building frame as a unit extending between a pair of upright columns. This beam includes an elongate, axially central, vertical through-passage located between its ends for accommodating the vertical passage through the beam of selected building infrastructure to extend between floors in a building.

3 Claims, 2 Drawing Sheets

STRUCTURAL CHASE BEAM

CROSS-REFERENCE TO RELATED APPLICATION

This application claims the priority filing date, Nov. 5, 2002, of U.S. Provisional Patent Application, Ser. No. 60/424,079, which provisional application is directed toward the same invention disclosed and claimed in this application entitled "Structural Chase Beam". The entire contents of this prior provisional case are hereby incorporated herein by reference.

BACKGROUND AND SUMMARY OF THE INVENTION

This invention relates to elongate beam structure useable between upright columns in a building frame structure. More particularly, it relates to a novel chase beam structure which includes, along much of its length, a vertically open through-passage, referred to herein as a chase passage, which lies generally in the vertical plane occupied by the beam's long axis when the beam is installed in operative condition in a building. This chase passage conveniently accommodates certain necessary "between-floor" routing of various support infrastructure, such as wiring, ducting and plumbing, in a plural-story building.

The chase beam of this invention not only furnishes such an infrastructure-accommodating chase passage, but also is designed to have a relatively simple and easy-to-fabricate structural organization which, in other respects, provides all of the necessary, and normally expected, beam load-bearing functionality. Additionally, the beam of the invention features opposite end regions, at least one of which, though preferably both, are configured with appropriate overload fuses.

These and other features and advantages which are offered and attained by the invented chase beam will become more fully apparent as the detailed description which now follows is read in conjunction with the accompanying drawings.

DETAILED DESCRIPTION OF THE INVENTION

Figure 1:
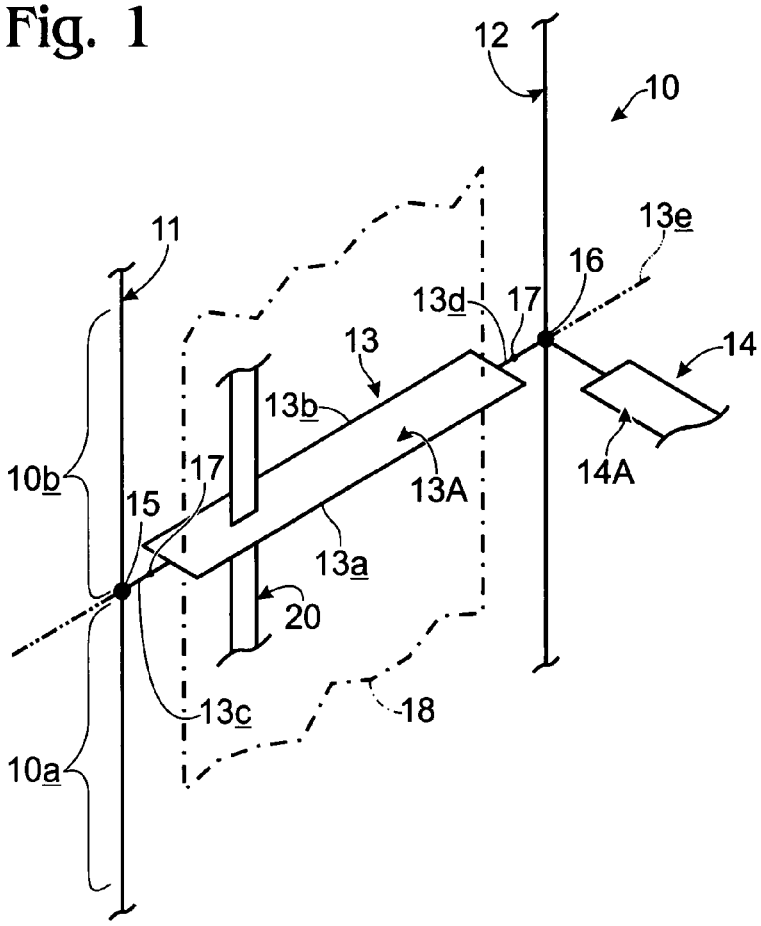
FIG. 1 is a fragmentary, isometric view of a fragmentarily shown, plural-story building frame structure which employs chase beams made in accordance with a preferred and best-mode embodiment of the present invention. In this figure, two next-adjacent upright columns, portions of two stories in the structure, a single chase beam, a portion of the upright plane of that beam's provided vertical through-passage, and fragmentary portions of between-floor infrastructure, are shown.

Shown generally at 10 in FIG. 1 is a plural-story building frame structure, or frame, which includes upright, vertical columns, such as the two columns shown at 11, 12, and extending generally horizontally between various ones of these columns, elongate chase beams, such as the two specifically illustrated at 13, 14. The opposite ends of these beams, as is true with respect to the opposite ends of all other beams employed in frame 10, are suitably load-transmissively anchored to the two particular columns between which they respectively extend. Beam 13 extends between columns 11, 12. One end of beam 14 extends to column 12. Details of such anchoring are not relevant to the present invention, and so, are only represented herein very simply and schematically at locations 15, 16 which are pictured schematically by two large black dots. Any appropriate anchoring modality, including one which produces a moment connection, may be employed.

The building for which frame 10 is constructed is, as mentioned, a multi-or plural-story building, and beams 13, 14 essentially lie horizontally in a region between two of the building stories which are indicated generally at 10*a* (lower), and 10*b* (higher) by brackets provided on the left side of FIG. 1.

Still just speaking in general, overview terms, according to an important contributed novel feature of the present invention, each chase beam employed in frame 10 is designed with a vertically open, elongate chase passage through which routed building infrastructure, like that mentioned earlier herein, can freely and easily pass vertically from floor-to-floor (story-to-story). Chase beam 13 is accordingly, and pursuant to a preferred and best-mode embodiment of the invention, constructed with a pair of elongate, laterally spaced central spanner portions 13*a*, 13*b*, and joined thereto, a pair of longitudinally spaced end portions 13*c*, 13*d*. It is end portions 13*c*, 13*d* which are secured to columns 11, 12, respectively. These two end portions essentially define the opposite ends of beam 13, and the beam's long axis is shown generally at 13*e*. Chase beam 14 is similarly constructed.

For chase beams 13, 14, their respective associated clear-space chase passages (also referred to as passages) are shown at 13A, 14A, respectively. Passing vertically through chase passage 13A in beam 13 is a vertical plane 18 (shown fragmentarily by dash-dot lines in FIG. 1). Illustrated fragmentarily at 20 is certain building infrastructure which extends in plane 18 and through passage 13A between floors 10*a*, 10*b*. Plane 18 passes through and contains beam axis 13*e*.

Included, in the particular form of the invention now being described, in each end portion 13*c*, 13*d* is an otherwise conventional overload fuse. These fuses are illustrated just schematically in FIG. 1 as small black dots 17.

Figure 2:
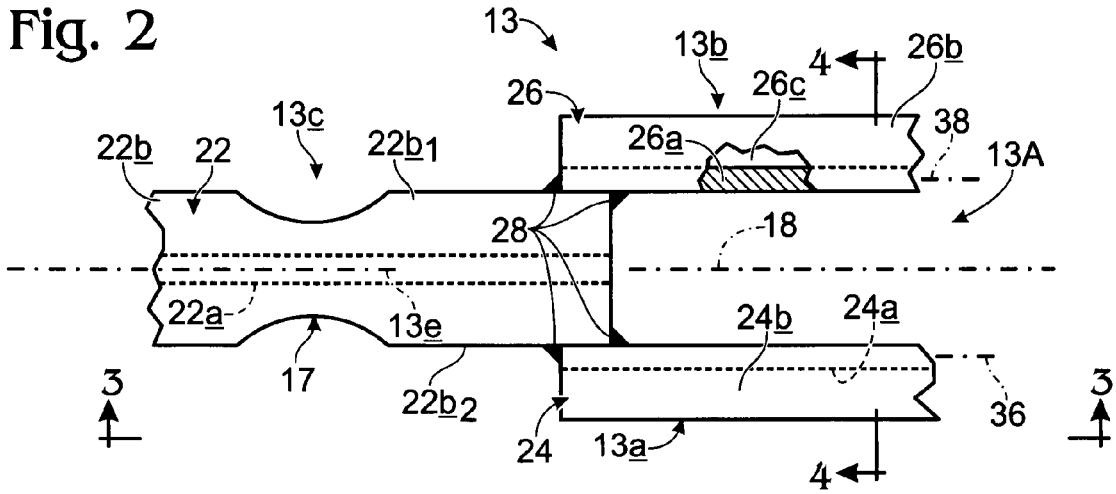
FIG. 2 is a fragmentary top plan view, drawn on a larger scale than that employed in FIG. 1, isolating and illustrating structural details of one end of the chase beam which is illustrated schematically in the frame structure of FIG. 1. This illustrated chase beam is constructed in accordance with a preferred and best-mode embodiment of the invention.
Figure 3:
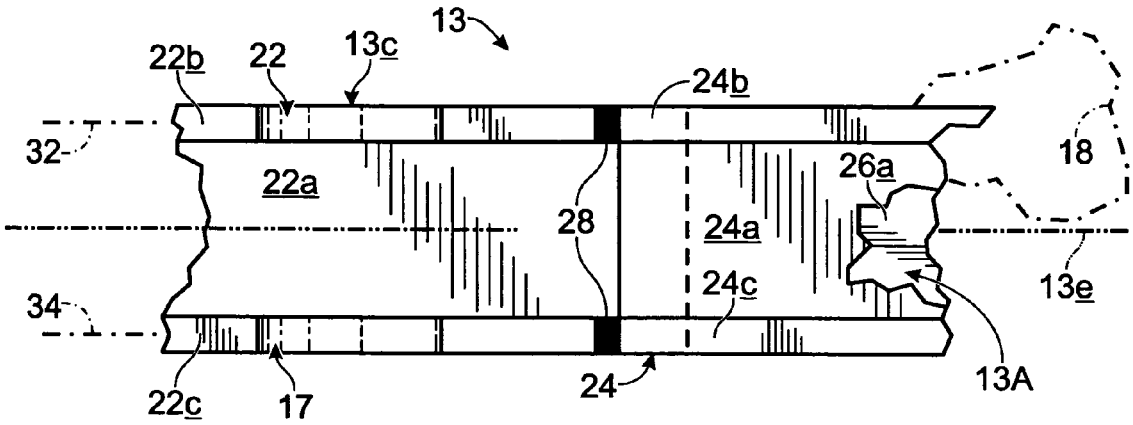
FIG. 3, taken generally along the line 3-3 in FIG. 2 is a fragmentary side elevation of the end of the chase beam shown in FIG. 2. A portion of the central web in one channel member (the near channel member in FIG. 3) that forms part of this beam has been cut away to reveal a small portion of another channel member which also forms part of the beam.
Figure 4:
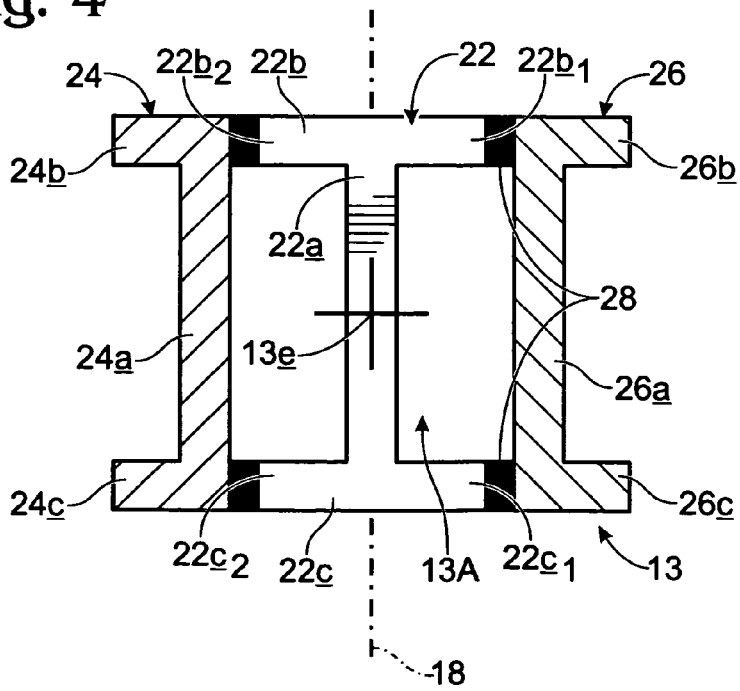
FIG. 4 is an enlarged, plural-plane, cross-sectional view taken generally along the line 4-4 in FIG. 2, and rotated 90° clockwise therfrom.

Directing attention now to FIGS. 2-4, inclusive, along with FIG. 1, details of (one end region of) chase beam 13, and of its vertically open chase passage 13A, are here pictured. It should be understood that the specific description now to be given for beam 13 is to function as a description of each and every other chase beam, such as chase beam 14, in frame 10. It should also be understood that references made herein to the horizontal and to the vertical are so made in the context of visualizing a chase beam as being oriented in a normal and intended operative condition in a building frame structure, such as in frame structure 10. Plane 18 is represented by dash-dot lines in FIGS. 2 and 4, and by a dash-dot fragment in FIG. 3.

Beam 13 herein is preferably made up of an assembly of four joined (welded) together members. These include, as end portions 13*c*, 13*d*, a pair of longitudinally spaced, I-beam members, such as I-beam members, 20, 22, which define the opposite ends of the beam, and as spanner portions 13*a*, 13*b*, a pair of elongate, laterally spaced, channel members, 24, 26 which extends between the I-beam members and define the long opposite sides of chase passage 13A. I-beam 22 includes a central web 22*a*, and spaced upper and lower flanges $\mathbf{22}b_1$, $\mathbf{22}b_2$, and $\mathbf{22}c_1$, $\mathbf{22}c_2$. Channels 24, 26 include central webs 24*a*, 26*a*, respectively, and the usual associated, one-side-extending flanges 24*b*, 24*c*, and 26*b*, 26*c*. Welds joining these I-beam and channel members are shown at 28. Member 22 is also referred to herein as an I-beam, and members 24, 26 as channels.

Each of the previously mentioned overload fuses 17, one of which is pictured structurally in member 22 in FIG. 2 and 3, is, on its own, generally conventional in construction. It takes the form herein of inwardly curved removed-material regions in the flanges in an I-beam end member. Its optional inclusion in a chase beam made in accordance with the present invention is indicative of the special utility of this beam in terms of the beam's being readily employable in place of conventional beams where the unique offering also of a vertical chase passage is desired.

The end members, such as member 22, are longitudinally aligned in such a manner that their respective central webs, and their upper and their lower flanges lie in respective, shared, common planes. The common plane shared by the central webs is previously mentioned, vertical plane 18. The common plane shared by the upper flanges is shown in FIG. 3 by a dash-dot line 32. The common plane shared by the lower flanges is shown (also in FIG. 3) by a dash-dot line 34.

With respect to the channels, central webs 24*a*, 26*a* lie in substantially parallel, spaced, vertical planes shown by dash-dot lines 36, 38, respectively, in FIG. 2. The channel's upper and lower flanges are substantially co-planar with the upper and lower flanges respectively, in the I-beam end members as can be seen. The confronting, inwardly facing faces of webs 24*a*, 26*a* are spaced apart by a distance which is essentially the same as the overall lateral widths of the flanges in the I-beam end members, such as between the lateral edges of the flanges in member 22.

Given this just-described structural arrangement of the four members that make up beam 13, one can see (a) that vertically open chase passage 13A is centered on plane 18 (which contains beam axis 13*e*), (b) that this passage has a long dimension measured by the longitudinal spacing which exists between the two beam end members, and (c) that passage 13A has a width which is substantially the overall width of each I-beam end member.

One way of re-visualizing the chase beam structure of this preferred and best-mode embodiment of the invention which has just been described is to recognize that the longitudinally central spanning members, if brought together and joined to one another to close the gap which forms the chase passage, would effectively form an I-beam cross-section member. Thus, the preferred embodiment of this invention can be thought of functionally as being effectively an I-beam structure in which the longitudinal central portion has been laterally "split" into two channel sections to "open up" and "create" a chase passage. This way of visualizing the invention helps to promote an understanding that the herein-proposed creation of a vertical, axially central chase passage in what is figuratively "otherwise" an I-beam continuum does not in any significant way diminish the expected and desired load-bearing capability of a comparable, un-modified and otherwise conventional I-beam.

Thus the present invention proposes a novel structural beam, referred to herein as a chase beam, which includes a clear chase passage which accommodates the routing of selected building infrastructure through the beam from story-to-story in a building. A preferred and best-mode embodiment of the invention is formed with four unitarily assembled members, including two opposite end members which have I-beam cross sections, and two intermediate and laterally spaced spanner members which have channel cross sections.

The features of the invention may, it will be understood by those skilled in the art, be created using other specific structural configurations. One way of expressing the opportunities for such other styles of configurations is to characterize the basic elements of the invention as including an elongate chase beam which is defined by (a) a pair of longitudinally spaced, opposite end portions, and (b) an elongate spanner portion which includes a central through-passage that lies generally in a plane containing the beam's long axis. Described this way, it should be clear that the end and spanner portions need not necessarily possess respective I-beam and channel cross sections. Nor is it necessary that the beam of this invention be formed from an assembly of initially separate components.

Accordingly, while a specific preferred and best mode embodiment of the invention has been described and illustrated herein, it is appreciated that variations and modifications may be made without departing from the spirit of the invention.

I claim:

1. An elongate structural chase beam adapted for assembly in a building frame as a unit extending laterally between, and with opposite ends anchored to, a pair of upright columns, and further adapted to accommodate the vertical passage of selected building infrastructure through, and generally within the vertical plane containing the long axis of, the beam, said beam comprising a pair of longitudinally spaced end portions defining opposite ends of the beam, wherein each end portion includes an I-beam component possessing spaced flanges with spaced, opposite-side pairs of outwardly facing lateral edges, and a pair of elongate, laterally spaced and generally parallel spanner portions extending between and having opposite ends operatively joined to said end portions, the space between said spanner portions defining a vertically clear chase passage extending as a clear space through the beam generally about a plane containing the beam's long axis, each spanner portion taking the form of a channel including a central web and a pair of spaced flanges extending from one side of the central web, with the spanner portions and each end portion being joined in a manner whereby the spanner portions' central webs are anchored to the lateral edges of different ones of associated, opposite-side pairs of the end portion's outwardly facing lateral edges, with the flanges in the spanner-portions extending outwardly away from the attached end-portion.

2. The chase beam of claim 1, wherein at least one of said end portions includes an overload fuse.

3. The chase beam of claim 1, wherein each of said end portion includes an overload fuse.

* * * * *